United States Patent [19]

Hilterhaus et al.

[11] Patent Number: 4,859,650

[45] Date of Patent: Aug. 22, 1989

[54] PRESSURE-SENSITIVE RECORDING MATERIAL

[75] Inventors: Bodo Hilterhaus, Monchengladbach; Günther Hunger, Korschenbroich, both of Fed. Rep. of Germany

[73] Assignee: Feldmühle Aktiengesellschaft, Fed. Rep. of Germany

[21] Appl. No.: 103,115

[22] Filed: Sep. 30, 1987

[30] Foreign Application Priority Data

Sep. 30, 1986 [DE] Fed. Rep. of Germany ..... 3633116

[51] Int. Cl.[4] ..... B41M 5/16; B41M 5/22

[52] U.S. Cl. ..... 503/213; 427/150; 427/151; 428/16; 428/17; 428/914; 503/215; 503/224

[58] Field of Search ..... 427/150–152; 503/213, 224; 428/914, 16, 17

[56] References Cited

U.S. PATENT DOCUMENTS

| | | | |
|---|---|---|---|
| 3,871,900 | 3/1975 | Hayashi et al. | 503/212 |
| 4,398,753 | 8/1983 | Asano et al. | 428/914 |
| 4,460,199 | 7/1984 | Hosoi et al. | 428/914 |
| 4,580,153 | 4/1986 | Kondo et al. | 503/224 |

FOREIGN PATENT DOCUMENTS

| | | | |
|---|---|---|---|
| 2011634 | 7/1979 | United Kingdom | 503/224 |

*Primary Examiner*—Bruce H. Hess

*Attorney, Agent, or Firm*—Michael J. Striker

[57] ABSTRACT

A pressure-sensitive recording material is disclosed, having microcapsules containing a triphenylmethane leuco-dye dissolved in a solvent composed at least 80% of plant, animal or paraffin oils, the microcapsule walls being formed of a wall material which is water-soluble or water-dispersible before the formation of the microcapsules. Preferably, the color former is of the formula

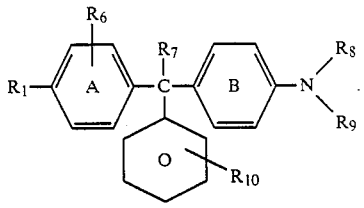

10 Claims, No Drawings

PRESSURE-SENSITIVE RECORDING MATERIAL

BACKGROUND OF THE INVENTION

The invention concerns a pressure-sensitive recording material with microcapsules, which contain a color former that is prepared on the basis of a triphenylmethane leuco-dye and that is dissolved in a solvent, characterized in that the color former is dissolved in a solvent composed at least 80% of plant, animal or paraffin oils, and the microcapsules are formed of a wall material which is water-soluble or water-dispersible before the microcapsule formation.

Color formers based upon triphenylmethane leuco-dyes are described in German Offenlegungsschrift No. DE-OS 2750283. These color formers effect an excellent formation of color upon contact with acid reactants. In order to be able to place this class of color formers into pressure-sensitive recording materials, they are dissolved in suitable solvents, of which DE-OS No. 2750283 names partially hydrated terphenyl, alkylated naphthaline and dibutylphthalate. Thereafter, the dissolved color formers are enclosed according to known techniques in microcapsules. The mentioned solvents are occasionally viewed with distrust, causing skin irritations upon use of the carbon paper manufactured therewith. On the other hand, there are also objections in particular upon repeat preparation of microcapsule-containing papers having breaks in the paper fabric.

Accordingly, there exists a need to be able to substitute these solvents by such solvents which are less hazardous in this connection. European Patent No. EP-A-167900 suggests, in particular, alkylated products of diphenylmethanes, e.g. ethyl diphenylmethane or alkylated products of diphenylethanes, e.g. ethyldiphenylethane. This reference discloses, as typical color formers, crystal violet lactone and N-leuco-auramine. The availability of these solvents is not, however, always simple. Moreover, it is not certain that the requisite expectations can be fulfilled by these solvents, to the broadest extent of unobjectionableness.

The older German Offenlegungschriften Nos. DE-OS 2242910, 2251350, 2306454 and 2726782 indeed extensively mention as being unobjectionable, oil-like substances such as e.g. paraffin oil, soy oil and fish oil. However, these oils were previously only considered as fillers, the last three of the above-mentioned Offenlegungschriften disclosing an amount of 0 to 3 parts by weight per weight part of an expressly well dissolving means for the color former. Whereas DE-OS No. 2242910 mentions only the possibility of encapsulation of the oil, without going into the particulars of the solvent characteristics for the known color formers, DE-OS No. 2306454 expressly states that these oils, designated as diluting agents, display only slight practical value as solvents, and inhibit the development of color. Their function is to reduce the cost and influence the physical characteristics, such as viscosity or vapor pressure. Actual tests of the applicants have proven that disadvantages with regard to the color reaction arise when the amount of the fillers is selected to be greater than 20 to 30%, relative to the total solvent mixture European Patent No. EP-A-24898 suggests a solvent mixture of aromatic hydrocarbons and ester components in determined ratio whereby such solvent mixtures can, advantageously, be cut at leas to 50% by weight, and only in exceptional cases with greater amounts, of inert diluting agents, such as e.g. mineral or plant oils.

Also European Patent No. EP-A-86636, in which among a plurality of high-boiling solvents, the aromatic hydrocarbons are given preference over oils of animal or plant derivation, as well as mineral oils, expresses the generally prevailing opinion that the naturally occurring oils of mineral, animal or plant basis, are less well suitable, since they, despite their known physiological unobjectionableness, are also known as poor dissolvers for the customary color formers, and their use in significant amounts results in less of a color forming behavior, in particular a decreased color intensity.

SUMMARY OF THE INVENTION

The present invention is therefore based upon the object of making available a pressure-sensitive recording material, with which the color former enclosed in the microcapsules is dissolved in a solvent that is as unobjectionable as possible from the physiological viewpoint.

Therewith, however, one should not have to forego the advantages of the known recording materials, such as e.g. fast color development and high color intensity, upon contact of the color former with a suitable reactant.

This object is attained according to the present invention by employing a color former prepared on the basis of a triphenylmethane leuco-dye, and dissolved in a solvent composed at least 80% by weight of plant, animal or paraffin oils, and forming the microcapsules from a wall material that is water-soluble or water-dispersible before the microcapsule formation.

Preferably, the color former is of the formula

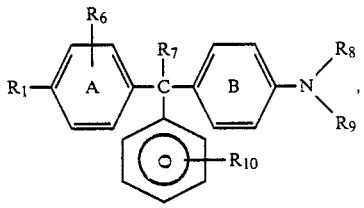

wherein $R_1$ is alkoxy or the group

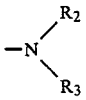

$R_2$ and $R_3$ are the same or different and are each alkyl or aryl, or $R_2$ together with the ring A, in o-position to the nitrogen, form a ring of the formula

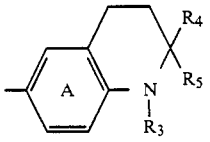

$R_4$ and $R_5$ are alkyl $R_6$ is hydrogen or alkoxy $R_7$ is hydroxy or alkoxy $R_8$ and $R_9$ are the same or different and are each alkyl, aryl or cyano-substituted aryl and $R_{10}$ is hydrogen or alkoxy.

Attempts have previously been made to overcome the problems with regard to objectionableness of the solvent towards the color former, or provision of a fast color reaction and high degree of color intensity, by suggesting always new solvent for the color former or mixtures of known solvents. The present invention abandons this trend and attains the above-mentioned objective by recourse to the oils known from the prior art, the unobjectionableness of which have been proven for years, but to which have previously attached the reputation of possessing a poor dissolving power for the color former, and therewith of leading to poor color formation behavior, specifically, slow color reaction and low intensity of color.

These disadvantages of the known plant and animal oils, as well as of paraffin oils, are overcome according to the present invention by employing a color former based upon a triphenylmethane leuco-dye, which is soluble in the mentioned solvents.

According to a preferred embodiment of the present invention, the solvent for the color former is composed completely of e.g. plant oils. In order to obtain as broad as possible an unobjectionableness, it has proven to be sufficient when at least 80% by weight of the employed solvent is composed of the oils suggested according to the present invention. As residual solvent, one can employ any of the solvents known for this particular type of color former, i.e. such as alkylated naphthaline, hydrated terphenyls, alkylated biphenyls, diphenylethanes, alkylbenzenes, chloroparaffins, or mixtures of these compounds. With an addition of more than 20% by weight of such solvents, there are increased drawbacks, with regard to objectionableness.

The choice of capsule wall material is of considerable significance in the scope of the present invention, inasmuch the microcapsules must be manufactured from an initially dissolved state. Water-soluble polymers or water-dispersible hydrocolloids and even also dispersible synthetics have proven suitable for production of capsule wall materials in order to encapsulate the droplets composed of solvent and the therein dissolved color former, according to the present invention.

Preferred embodiments of the present invention include employment of the following specific triphenylmethane leuco-dye based color formers:

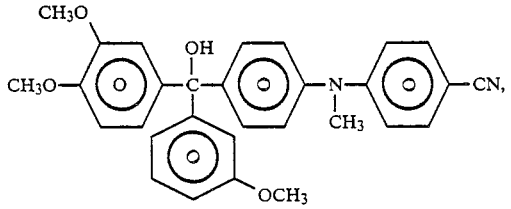

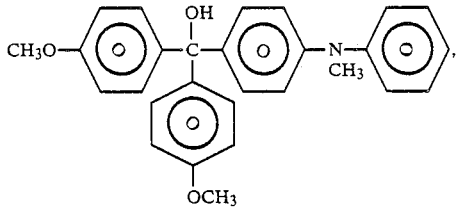

-continued

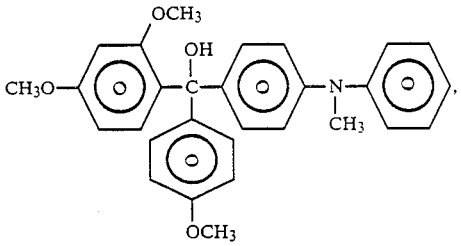

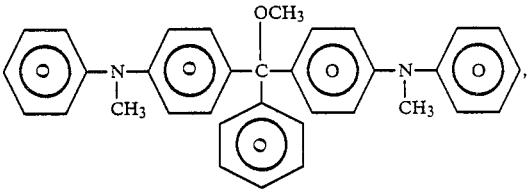

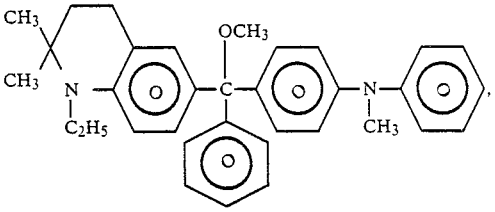

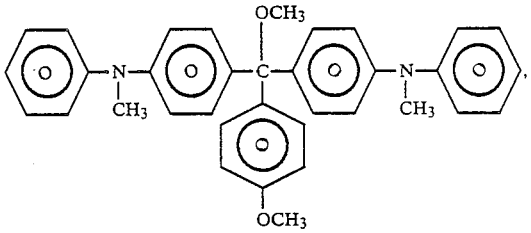

and also mixtures of these color formers, which are advantageous in particular to obtain specific color tones.

Preferably, the plant oil according to the present invention is selected from the group consisting of olive oil, cotton seed oil, wheat oil, soy oil, castor oil, thistle oil, peanut oil, sunflower oil, coconut oil, rapeseed oil, sesame oil and mixtures of two or more of these oils.

The animal oil according to the present invention is preferably selected from the group consisting of Whale oil, sperm oil, fish oil and mixtures of two or all of these oils.

So-called white oil has proven to be a particularly favorable paraffin oil.

The preferred materials for formation of the microcapsule wall are urea-formaldehyde, melamin-formaldehyde and gelatin-gum arabic.

Among mineral oils, especially white mineral oil and spindle oil, and further pareffinum liquidum known from medical field according to DAB8 (Deutsches Arzneimittelbuch, 8th edition), have proven particularly suitable.

Manufacture of the microcapsules follows according to techniques that are known per se, such as e.g. the conservation technique described in German Offenlegungsschriften DE-OS No. 1122495 and DE-OS No. 2225274. These references also describe suitable water-soluble polymeric substances, such as e.g. pig skin gelatin, gum arabic, cellulose compounds and polyvinyl alcohol. Manufacture of the microcapsules from urea-formaldehyde resins is disclosed U.S. Pat. No. 3,516,941. Applicants emphasize, however that the present invention is not limited to the employment of the encapsulation techniques and capsule wall materials disclosed in these references, which are only exemplary. In addition, the recording material according to the present invention can be manufactured with all microcapsules, the walls of which are formed from material initially dissolved or dispersed in water, whereby for the formation of a tight and resistant capsule wall, if necessary, still additional hardening steps are employed, or such substances are added, which can effect a further hardening of the capsule wall.

The novel features which are considered characteristic for the invention are set forth in particular in the appended claims. The invention itself, however, both as to its construction and its method of operation, together with additional objects and advantages thereof, will be best understood from the following description of specific embodiments.

DESCRIPTION OF THE PREFERRED EMBODIMENTS

EXAMPLES 1-13

Solutions of color formers, corresponding to the following Table, are prepared at temperatures from 25° to 40° C., and then encapsulated in a melamin-formaldehyde pre-condensate. The prepared microcapsules are applied to the reverse side of a wood-free paper. Upon pressure contact with a receiving paper coated with acid color reactants, a good color reaction and an outstanding color intensity are observed, particularly with Examples 1 through 4. Good results with regard to color intensity occur also in Examples 5 through 9, whereas in contrast, Example 10 displays slightly less color intensity. Satisfactory results are obtained with Examples 11 through 13.

COMPARISON EXAMPLE 1 part by weight of a typical commercially available color former for a green dye, 2'[bis(phenyl methyl-)amino]-6'-(diethyl-amino)-4'-methyl-spiro-[isobenzofuran-1-(3h),9'-(9h) xanthene]-3-on, is stirred into 100 parts by weight sunflower oil at a temperature of 80°-90° C. Even after several hours, the color former does not go completely into solution. The mixture is applied by means of an RK-coater (intaglio printing plate onto a receiving paper, after which an extremely slow color reaction is observed, which leads to an unsatisfactory color intensity. Repetitions of this test with a mixture of 75 parts by weight sunflower oil and 25 parts by weight diisopropylnaphthaline, whereby the color former indeed goes visibly more into solution, provide the same result, i.e. slow color formation and low color intensity.

It is first after a solution of the color former in pure diisopropylnaphthaline is employed, that a sufficient speed of color formation and high color intensity are observed.

It will be understood that each of the elements described above, or two or more together, may also find a useful application in other types of materials differing from the types described above.

While the invention has been illustrated and described as embodied in a pressure-sensitive recording material, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt if for various applications without omitting features that, from the standpoint of prior art, fairly constitute essential characteristics of the generic or specific aspects of this invention.

TABLE OF COLOR TEST SAMPLES 1-13

| EXAMPLE # | COLOR FORMER OF CLAIM # | PARTS BY WEIGHT | COLOR FORMER OF CLAIM # | PARTS BY WEIGHT | SOLVENT | PARTS BY WEIGHT | SOLVENT | PARTS BY WGT. |
|---|---|---|---|---|---|---|---|---|
| 1 | 4 | 7 | 6 | 3 | Dialkylnaphthaline | 25 | Sunflower oil | 165 |
| 2 | 4 | 7 | 6 | 3 | Dialkylnaphthaline | 25 | Olive oil | 165 |
| 3 | 4 | 7 | 6 | 3 | Dialkylnaphthaline | 36.2 | Paraffin oil | 153 |
| 4 | 4 | 7 | 6 | 3.3 | Hydrated terphenyl | 35.6 | Paraffin oil | 153 |
| 5 | 4 | 7 | 6 | 3.3 | | | Sunflower oil | 191 |
| 6 | 4 | 7 | 6 | 3.3 | | | Olive oil | 191 |
| 7 | 4 | 7 | 6 | 3.3 | | | Wheat oil | 191 |
| 8 | 4 | 7 | 6 | 3.3 | | | Castor oil | 191 |
| 9 | 4 | 7 | 6 | 3.3 | Sunflower oil | 35.6 | Paraffin oil | 145 |
| 10 | 4 | 7 | 8 | 3 | Dialkylnaphthaline | 90 | Rapeseed oil | 100 |
| 11 | 3 | 10 | | | Dialkylnaphthaline | 25 | Sunflower oil | 165 |
| 12 | 5 | 7 | 6 | 3 | Dialkylnaphthaline | 25 | Sunflower oil | 165 |
| 13 | 5 | 8 | 7 | 3 | Dialkylnaphthaline | 25 | Sunflower oil | 165 |

Tabelle

| Beispiele | Farbbildner nach Anspr. | Gew.-Teil | Farbbildner nach Anspr. | Gew.-Teil | Losungsmittel Gew.-Teil | | | Gew.-Teil |
|---|---|---|---|---|---|---|---|---|
| 14 | 4 | 10 | — | — | Sonnenblumenol | 35,6 | Weiβol | 145 |
| 15 | 6 | 10 | — | — | Sonnenblumenol | 35,6 | Weiβol | 145 |
| 16 | 5 | 10 | — | — | Dialkylnaphthalin | 25 | Sonnenblumenol | 165 |
| 17 | 7 | 10 | — | — | Dialkylnaphthalin | 25 | Sonnenblumenol | 165 |
| 18 | 8 | 10 | — | — | Dialkylnaphthalin | 25 | Sonnenblumenol | 165 |

What is claimed as new and desired to be protected by Letters Patent is set forth in the appended claims.

We claim:

1. Pressure-sensitive recording material with microcapsules, comprising a color former, microscapsules and paper, wherein said color former is of the formula:

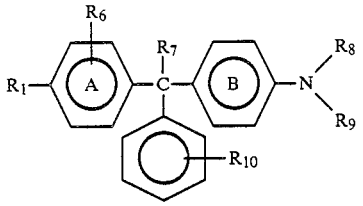

in which $R_l$ is alkoxy or the group

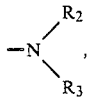

$R_2$ and $R_3$ are the same or different and are each alkyl or aryl, or $R_2$ forms with the ring A in o-position to the nitrogen, a ring of the formula

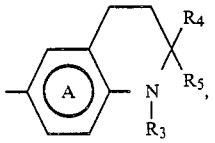

$R_4$ and $R_5$ are alkyl, $R_6$ is hydrogen or alkoxy, $R_7$ is hydrogen or alkoxy, $R_8$ and $R_9$ are the same or different and are each alkyl, aryl or cyano-substituted aryl and $R_{10}$ is hydrogen or alkoxy, said color former is prepared from a triphenyl-methane leuco-dye and dissolved in a solvent composed at least 80% of plant, animal or paraffin oils, said microcapsules are formed from a wall material which is water-soluble or water-dispersible before formation of said microcapsules, said dissolved color former being contained in said microcapsules, and said microcapsules being applied onto said paper.

2. The pressure-sensitive recording material according to claim 1 wherein said color former is of the formula:

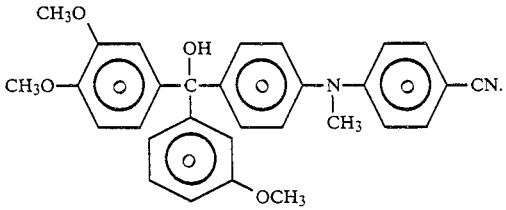

3. The pressure-sensitive recording material according to claim 1, wherein said color former is of the formula:

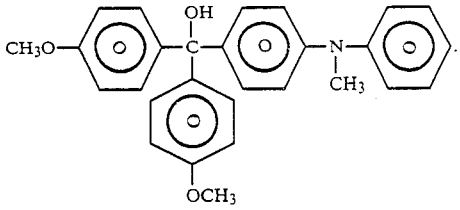

4. The pressure-sensitive recording material according to claim 1, wherein said color former is of the formula:

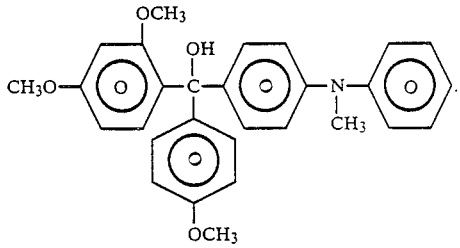

5. The pressure-sensitive according to claim 1, wherein said color former is of the formula:

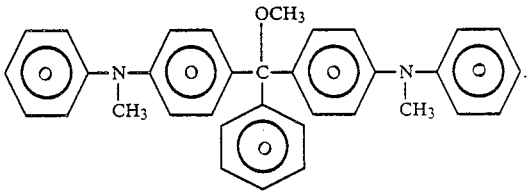

6. The pressure-sensitive recording material according to claim 1, wherein said color former is of the formula:

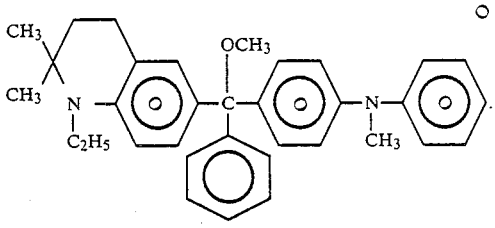

7. The pressure-sensitive recording material according to claim 1, wherein said color former is of the formula:

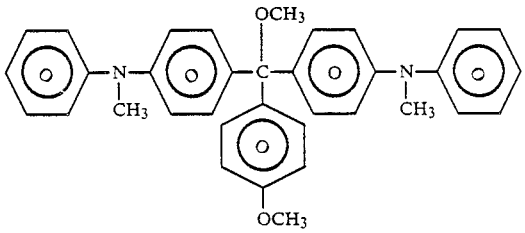

8. The pressure-sensitive recording material according to claim 1, wherein said plant oil is selected from the group consisting of olive oil, cottonseed oil, wheat oil, soy oil, castor oil, thistle oil, peanut oil, sunflower oil, coconut oil, rapeseed oil, sesame oil and mixtures of two or more thereof.

9. The pressure-sensitive recording material according to claim 1, wherein said animal oil is selected from the group consisting of whale oil, sperm oil, fish oil and mixtures of two or more thereof.

10. The pressure-sensitive recording material according to claim 1, wherein said wall material of said microcapsules comprises urea-formaldehyde, melamin-formaldehyde or gelatin-gum arabic.

* * * * *